US005454521A

United States Patent [19]

Frazier et al.

[11] Patent Number: 5,454,521

[45] Date of Patent: Oct. 3, 1995

[54] BALANCED COMMINUTING, VACUUM AND LOADING SYSTEM

[76] Inventors: Joan H. Frazier; Glenn L. Frazier, both of 15501 Little Valley Rd., Grass Valley, Calif. 95947

[21] Appl. No.: 326,194

[22] Filed: Oct. 20, 1994

[51] Int. Cl.[6] ..... B02C 23/18; B02C 23/24; B02C 9/04; B02C 13/04

[52] U.S. Cl. ..... 241/51; 241/60; 241/63; 241/88.4; 241/101.74; 241/189.1; 241/285.3

[58] Field of Search ..... 241/38, 49, 51, 241/60, 63, 73, 88.4, 101.7, 189.1, 194, 285.2, 285.3

[56] References Cited

U.S. PATENT DOCUMENTS

| | | | |
|---|---|---|---|
| 1,235,868 | 8/1917 | Williams | 241/51 |
| 1,960,346 | 5/1934 | Myers | 241/51 X |
| 2,105,759 | 1/1938 | Stevenson | 241/51 X |
| 2,333,247 | 11/1943 | Harris et al. | 241/49 X |
| 3,168,253 | 2/1965 | Masuda | 241/38 X |
| 3,496,922 | 2/1970 | Gifford | 241/101.7 X |
| 3,901,451 | 8/1975 | Lemke et al. | 241/38 |
| 4,961,539 | 10/1990 | Deem | 241/101.7 |

*Primary Examiner*—Timothy V. Eley
*Attorney, Agent, or Firm*—Harold D. Messner

[57] ABSTRACT

The system of the invention includes: a self propelled vehicle having a bed for receiving debris after comminution has occurred. The bed includes a cover. The cover has a filter of filter area A connected across an output opening of the cover; a frame attached to the self propelled vehicle and including ground engaging wheels defining a datum line; a comminuting chamber attached to the frame, an input opening in the comminuting chamber and an output opening, disc means having a shaft extending horizontally across the chamber and a driven pulley attached at one end thereof, a series of hammers attached to the disc means and movable therewith, and a grate at the periphery of the disc means; a vacuum chamber attached to the frame having an input opening attached to the output opening of the comminuting chamber and an output opening, an engine mounted to the frame at an end opposite to said comminuting chamber having a drive shaft including a drive pulley and an endless drive belt, the drive belt being attached to a pulley of the vacuum chamber and providing rotation of the shafts of both the comminuting and vacuum chambers in unison.

20 Claims, 6 Drawing Sheets

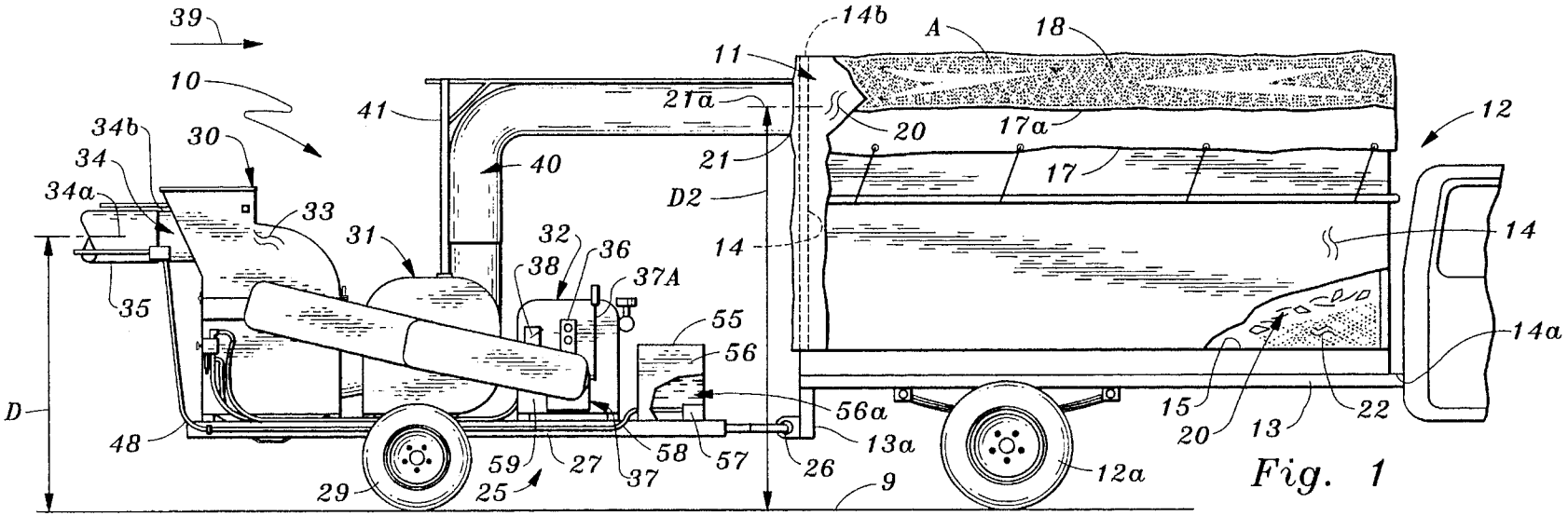
Fig. 1
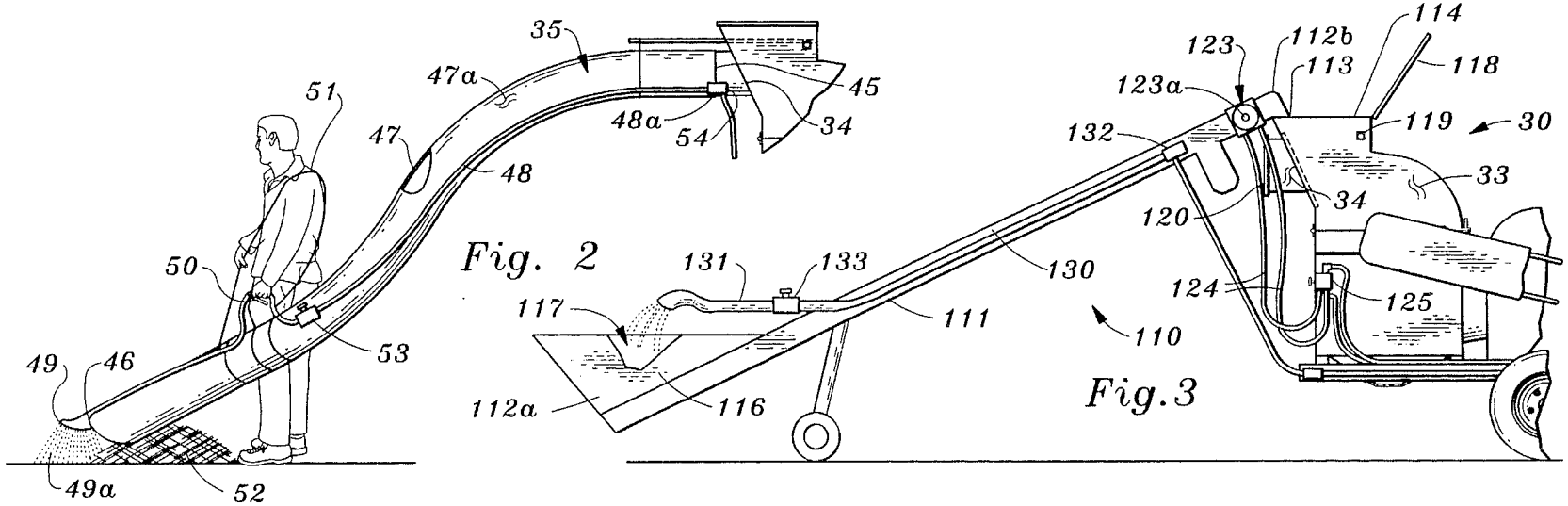
Fig. 3
Fig. 2

BALANCED COMMINUTING, VACUUM AND LOADING SYSTEM

SCOPE OF THE INVENTION

The present invention relates to leaf, lawn and garden debris disposal and more particularly to a portable system that vacuums, comminutes and loads such debris at a surprisingly high but balanced flow rate with minimum dust emission.

BACKGROUND OF THE INVENTION

The prior art is replete with apparatuses for vacuuming and pulverizing leaf, lawn and garden debris. Of those which we are aware include the following:

U.S. Pat. No. 4,360,166 relates to a motor-driven shredding apparatus with an inlet provided for lightweight garden waste. The inlet has an essentially vertical orientation and uses gravity to move debris shredded by shredding blades through the apparatus.

U.S. Pat. No. 5,102,056 relates to a horizontally-driven shredding apparatus with an inlet provided for essentially lightweight garden waste. While cooperation is provided between the shredding blades and fan blades attached to a common rotating disc, experience has shown that such cooperation limits the flow rate of debris through the apparatus to a relatively low rate, say to flow rates of 8000 cfm or less.

Experience has further indicated that the expulsion of air-born debris during shredding can be a sufficient environmental hazard. Where water is added to the inputted debris, the apparatuses of the prior art are even more ineffective and the additional weight leads to an unbalancing of the system, especially if the reservoir receiving the pulverized debris is essentially closed to the ambient air.

SUMMARY OF THE INVENTION

The present invention relates to a balanced comminuting, vacuuming and substantially dust-free loading system for debris. In the invention, the debris can contain small rocks up to 3 inch in diameter, or be lawn clippings, leaves and outcropping of trees, plants and the like that has been wetted to a slight degree. The system of the invention includes:

a rubber wheeled, self propelled vehicle having a bed for receiving debris after comminution has occurred. The bed includes upright walls and a cover attached to the upright walls. The cover preferably has a broad surface provided with an input opening and an output opening, and a filter of filter area A disconnectably connected across the output opening of the cover;

a frame trailerably attached to an end of the self propelled vehicle adjacent to the bed thereof and including ground engaging wheels defining a datum line;

a comminuting chamber attached to the frame at one end thereof having a plurality of side walls upwardly depending from the frame, and input opening a distance D above the datum line, for inputting debris interiorly of the comminuting chamber and an output opening through the side walls for outputting comminuted debris at distance D1 above the datum line, disc means located within the side walls having a shaft extending horizontally across the chamber and a driven pulley attached at one end thereof, a series of hammers attached to the disc means and movable therewith, and a grate at the periphery of the disc means through which the comminuted debris passes;

an air vacuum generating chamber attached to the frame at a midregion thereof, having an input opening attached to the output opening of the comminuting chamber in air vacuuming communication therewith, and an output opening horizontally positioned at a position a distance D2 above the datum line, a flywheel having a shaft and first and second pulleys attached at one end, an endless driven belt attached between the first pulley and the driven pulley of the comminuting chamber and a far region extending horizontally across the air pumping chamber, and a series of blades attached to the flywheel and movable therewith;

an engine mounted to the frame at another end opposite to the comminuting chamber having a drive shaft rotating in a range of 1800 to 2200 rpm including a drive pulley and an endless drive belt, said drive belt being attached to said second pulley of said air vacuum generating chamber and providing rotation of said shafts of both the comminuting and air pumping chambers in unison and of sufficient speed to drive debris at a flow rate Q through both the comminuting and air vacuum generating chambers, thence to the bed of the self propelled vehicle at a surprising high rate without harmful discharge of air-born debris exterior of the bed wherein filter A is sufficiently large to accommodate flow rate Q.

BRIEF DESCRIPTION OF THE DRAWINGS

FIG. 1 is a side view of the system of the invention depicting a self-propelled vehicle, a frame trailerably attached to a frame of the vehicle and a comminuting chamber, an air vacuum generating chamber and an engine carried on the frame wherein the output end of a vacuum hose is attached to the comminuting chamber;

FIG. 2 is partial perspective view of the vacuum hose of the FIG. 1 showing a user sweeping up debris from the earth's surface while wetting same using a water-carrying conduit;

FIG. 3 is a partial side view of the system of FIG. 1 in which the vacuum hose has been replaced by a conveyor;

DETAILED DESCRIPTION OF THE INVENTION

Figure 4:
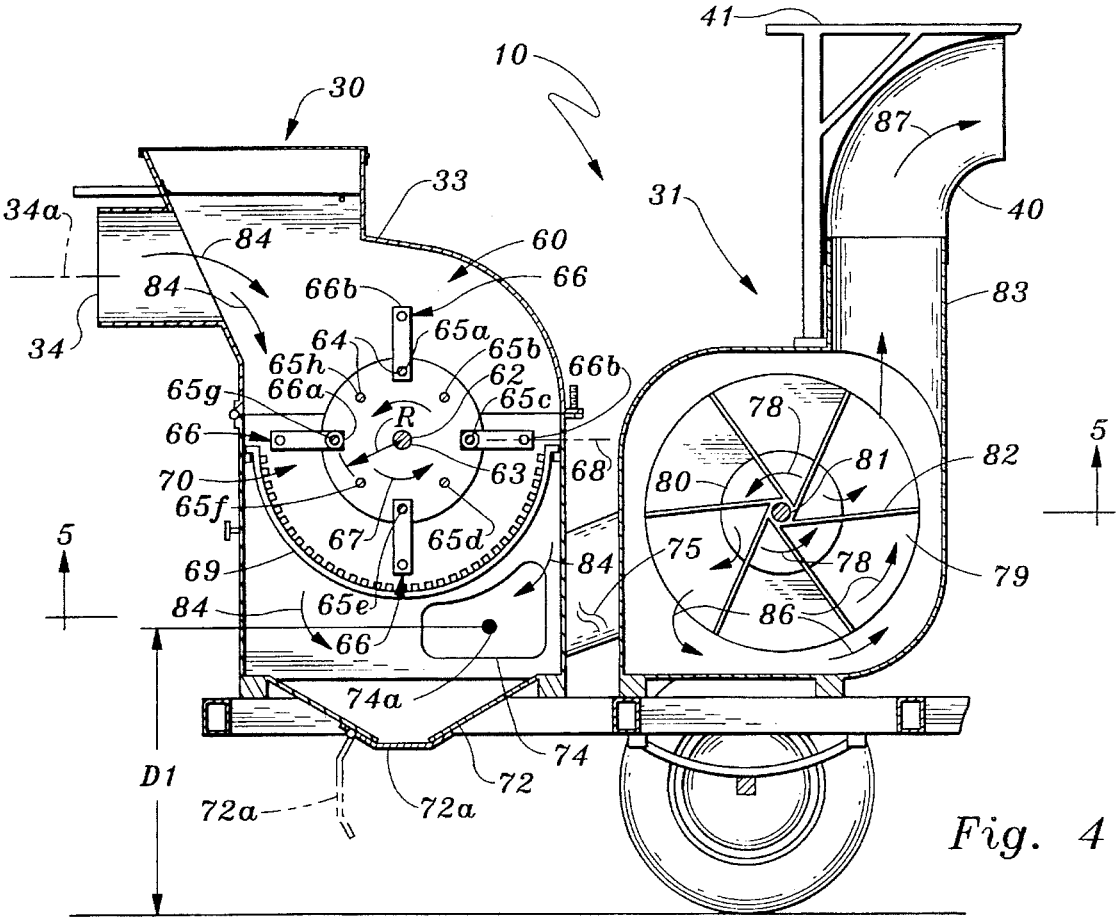
FIG. 4 is a partial side view of the system of FIG. 1 cut-away to show the comminuting and air vacuuming generating chambers in more detail.

Referring to FIG. 1, a balanced comminuting, vacuuming and dust-free loading system 10 is shown. The purpose of system 10: to shred, vacuum and unload debris (not shown) into a canopy-type bed 11 of a self-propelled vehicle 12, such as a conventional dump truck having rubber-tired wheels 12*a* in contact with the earth's surface 9 defining a datum line. The bed 11 includes a series of upright, vertical walls 14 attached at end 14*a* to floor 15. Across the other, more remote ends 14*b* of the vertical walls 14 is a cover 17. The cover 17 is formed of a plastic material having a large horizontally extending, output opening 17*a* fitted with a filter 18 of a conventional filter material such as fiberglass. Area A of the filter 18: in a range of 50 to 75 square feet to permit balanced egress of air flow from the vehicle 12, as explained below. Air flow within the bed 11 is controlled so that air-born debris 20 entering by way input opening 21, falls by gravity unto floor 15 of the bed 11 and forms pile 22. The input opening 21 is of circular cross section and defines an axis of symmetry 21*a* that is a distance D2 above the earth's surface 9, where D2 is usually about 7 feet.

A trailer 25 is attached to an end strut 13*a* of the frame 13 of the vehicle 12, via a trailer hinge 26 and includes a horizontal frame 27 in engagement with the earth's surface 9 through a wheel assembly 29. Atop the horizontal frame 27 are the following separate work stations: a comminuting chamber 30 and an air vacuuming generating chamber 31 powered—in unison—by an internal combustion engine 32.

The comminuting chamber 30 includes a plurality of side walls 33 upwardly depending from the horizontal frame 27 and an input port 34 of circular cross section defining a horizontal axis of symmetry 34*a* positioned a distance D above a datum line coincident with the earth's surface 9 where D is usually about 5 feet. Outer surface 34*b* of the input port 34 is frictionally connected to a vacuuming hose 35.

The engine 32 includes on-off controller 36, a clutch assembly 37 including engaging lever 37*a* and a speed controller 38 and translates rotational power to control various aspects of the invention as explained below.

The air vacuum chamber 31 is attached to the horizontal frame 27 of the trailer 25 over a mid-region above wheel assembly 29 and includes an output conduit 40 supported by L-shaped support arm 41 that penetrates the input opening 21 of the cover 17 fitted across the bed 11 of the vehicle 12. In operation, the air pumping chamber 31 is energized to cause air flow in the direction of arrow 39, i.e., through vacuuming hose 35, input port 34 of the comminuting chamber 30, and thence out of the air vacuum chamber 31 to the cavity bed 11 of the vehicle 12.

FIG. 2 shows the vacuuming hose 35 in more detail.

As shown, the vacuuming hose 35 has a remote end 45 attached to circular input port 34 of the comminuting chamber 30 and a near end 46. The vacuum hose 35 has a side wall 47 defining an exterior surface 47*a* on which is attached a water-carrying conduit 48. The conduit 48 has a sprayer 49 at one end an inverted U-shaped handle segment 50 by which user 51 controls both the positioning of the near end 46 of the vacuuming hose 35 above a pile 52 of unshredded debris and the directing of water droplets 49*a* from the sprayer 49, via on-off valve 53 in the conduit 48. A far end 48*a* of the conduit 48 is attached through a quick-release coupler 54 to a reservoir of water in the form of a water tank 55 positioned atop horizontal frame 27 of the trailer 25, see FIGS. 1 and 7. Note the tank 55 includes a plurality of walls 56 defining a cavity 56*a* into which is positioned a water pump 57 connected by hoses 58 to and driven by hydraulic pump 59 of the engine 32. In operation, the water pump 57 drives water through the conduit 48 to provide for wetting of the debris to usually a slight amount to limit dust generation.

FIGS. 4, 5 and 8–12show the comminuting and air vacuum chambers 30, 31 in detail.

Figure 5:
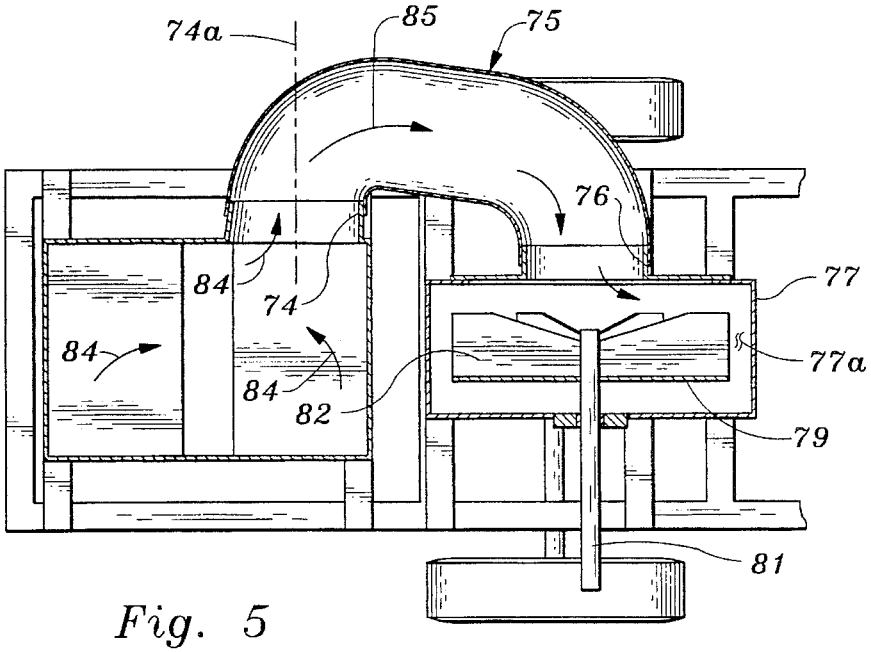
FIG. 5 is a section taken along line 5—5 of FIG. 4.

As shown in FIGS. 4 and 5, the comminuting chamber 30 includes an interior shredding assembly 60 positioned between and interior of the side walls 33 about midregion thereof, well below the input port 34 at the upper section of the chamber 30. The shredding assembly 60 includes a series of horizontally stacked discs 61 spaced across the entire width of the chamber 30 in which each is provided with central openings 62 for attachment to a central drive shaft 63 and more radially spaced openings 64 through which radial rods 65*a*–65*h* are attached at a common radius R. Hammer support rods 65*a*, 65*c*, 65*e*, 65*g* are equally spaced about the circumference of the stacked discs 61 and attach to working hammers 66 at attaching ends 66*a* thereof. That is, such hammers 66 rotate relative to the rods 65*a*, 65*c*, 65*e*, 65*g* as does the discs 61 in the direction of arrows 67 to assume the working positions depicted in FIG. 4 in which axes of symmetry 68 rotate outwardly so as to intersect at drive shaft 63. Hence, free ends 66*b* of the hammers 66 rotate about the drive shaft 63 as a series of hammer heads that pulverize debris that comes within cutting zone 70 defined by arcs of such rotation of the hammers 66. Note that in low regions of such arcs, the free ends 66*b* of the hammers 66 are alternately positioned adjacent to grate 69 which limits flow through of the shredded debris, exiting from the cutting zone 70. As a result, debris entering the comminuting chamber 30 via input port 34 is shredded by the shredding assembly 60 and then passes through grate 69 adjacent to floor 72 and thence out of the comminuting chamber 30 via output port 74. Note that the floor 72 is provided with a door 72*a*. When the door 72*a* is rotated to an open position as shown in phantom line, the grate 69 can be cleaned of clogged materials caught therein. Thereafter, the debris passes through U-shaped output pipe 75 connected to the output port 74 of the comminuting chamber 30 and thence into the air vacuum chamber 31. Note that the output port 74 is rectangular in cross section and includes an axis of symmetry 74*a* that is a distance D1 above the earth's surface 9 where D1 is usually about 4 feet.

Air vacuum chamber 31 has an input port 76 in one of a series of side walls 77 defining an interior cavity 77*a*, a flywheel 79 positioned within the cavity 77*a* having a central opening 80 fitted with a drive shaft 81 connected to the flywheel 79 via a series of blades 82 radiating at a common angle from the drive shaft 81. Rotation of the flywheel 79 in the direction of arrows 78 pumps air through output port 83 connected via the output conduit 40 to the canopy bed 11 of the vehicle 12, see FIG. 1. Since the input port 76 of the air pumping chamber 31 is in air communication with input port 34 of the comminuting chamber 30, rotation of the flywheel 79 generates flow of air through the system 10 of the invention in a variety of directions, viz., within the comminuting chamber 30 in the direction of arrows 84; in the direction of arrows 85 within the U-shaped output pipe 75 between the comminuting and air pumping chambers 30, 31; in the direction of arrows 86 in the air pumping chamber 31; and in the direction of arrows 87 in the output conduit 40 supported by L-shaped support arm 41. The air flow is sufficient to carry debris through all stations of the system 10, as explained below.

Figure 6:
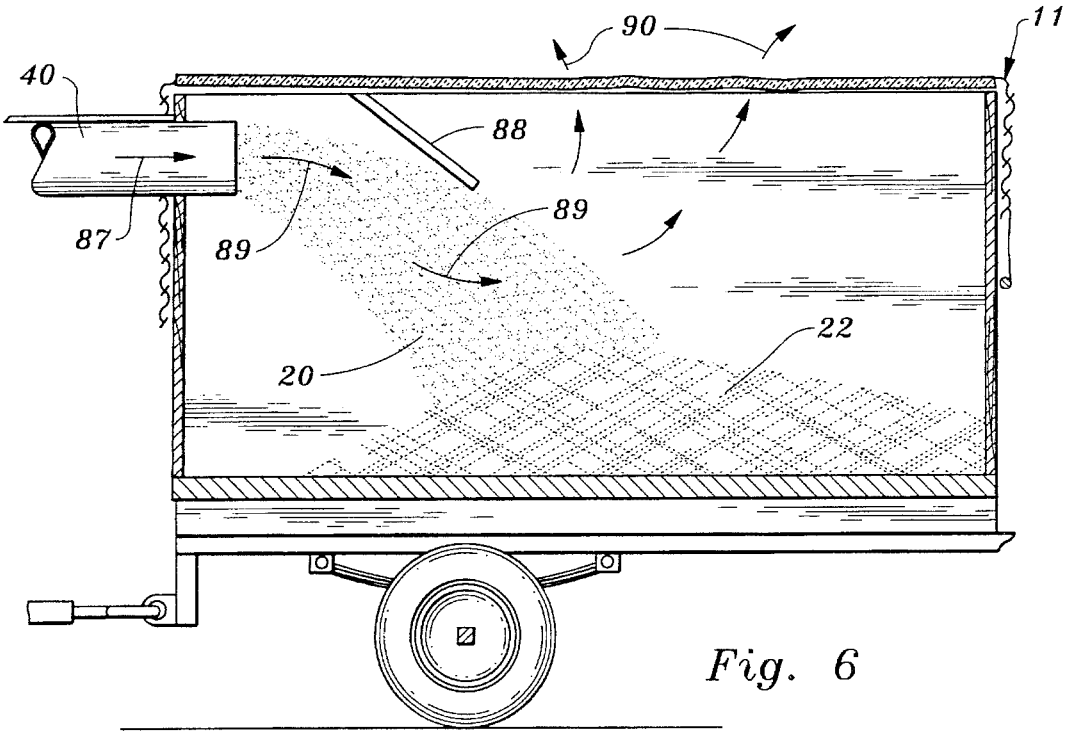
FIG. 6 is partial side view of the system of FIG. 1 cut-away to show the bed of the vehicle in more detail.

As shown in FIG. 6, within the canopy bed 11 of the vehicle 12, the generated air flow pattern is in the directions indicated. That is, exiting from the output conduit 40, the air bearing debris 20 enters in the bed 11 in a horizontal direction depicted by arrow 87, then is directed downward by the slant of baffle 88 along the direction of arrow 89 to cause deposition of the debris 20 into the pile 22 and thence is directed exterior of the vehicle 12 through the filter 18 in the center of the cover 11 as depicted by arrows 90.

Figure 7:
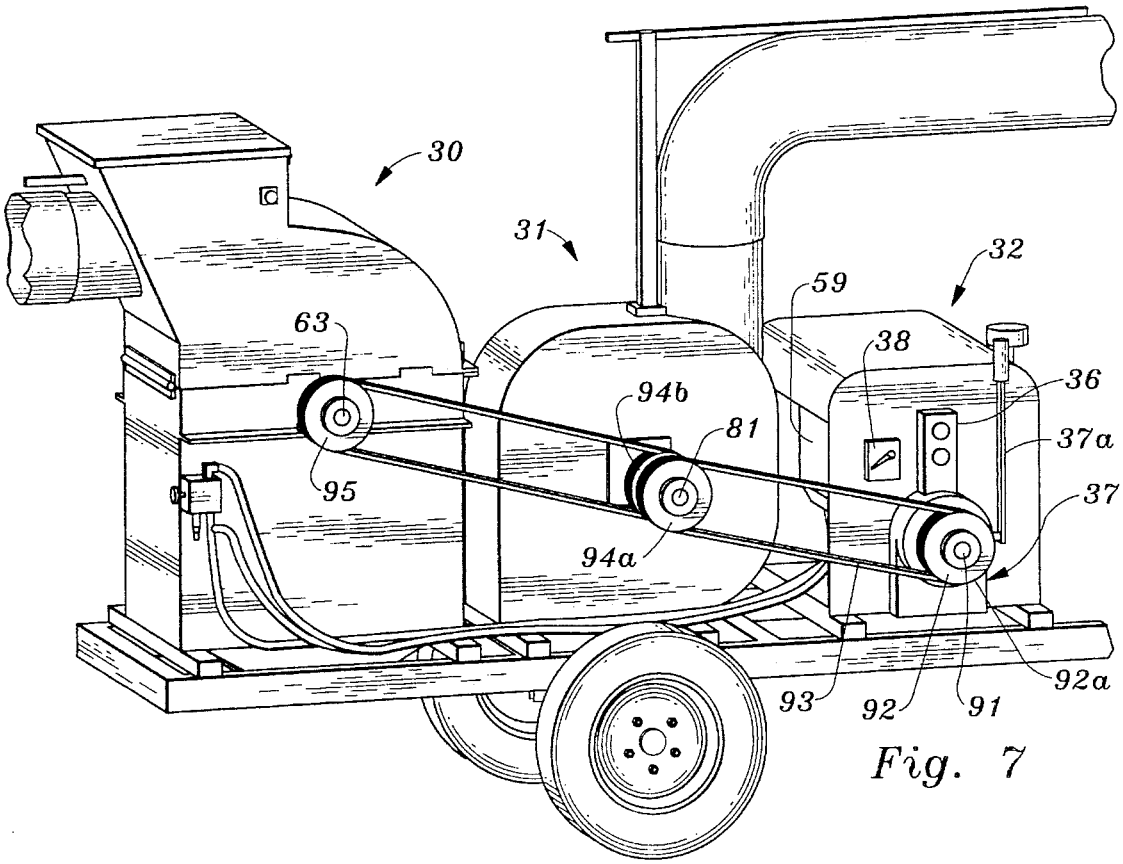
FIG. 7 is a partial perspective view of the comminuting and air vacuum chambers and engine of the system of FIG. 1 showing the drive pulley assembly in detail by removing the cowling of FIG. 1.

FIG. 7 shows that rotation of drive shafts 63, 81 of the comminuting and air vacuum chambers 30, 31 is a direct function of rotation of drive shaft 91 of the engine 32. In addition to on-off controller 36, clutch assembly 37 including engaging lever 37*a* and speed controller 38, the engine 32 also includes a drive pulley 92 attached to the drive shaft 91 having a periphery 92*a* on which is carried an endless belt 93. In turn, the endless belt 93 is connected through double driven pulleys 94*a*, 94*b* attached to shaft 81 of the air vacuum chamber 31, to pulley 95 attached to shaft 63 of the comminuting chamber 30. In that way, the speed of the drive shafts 63, 81 of the comminuting and air pumping chambers 30, 31 are directly related to the speed of rotation of the drive shaft 91 of the engine 32 in a ratio of 1:1. Where the speed of the drive shaft 91 of the engine 32 is between 1800 to 2200 rpm, similar speeds are developed for the operations of the comminuting and air pumping chambers 30, 31, respectively since the pulley diameters are the same so as to provide smooth total operations.

For example, the air vacuum chamber 31 is engineered based on such speed to provide a range of air flow rates, Q, in a range of 14,000 to 18,000 cfm to carry the un-shredded debris 52 of FIG. 2 into the comminuting chamber 30 and thereafter, to carry shredded debris from the comminuting chamber 30 through the air vacuum chamber 31 to the canopy bed 11 of the vehicle 12. In addition, the comminuting chamber 30 is provided with distinctive shredding operations because of its stacked design as depicted in detail in FIGS. 8–12.

Figure 8:
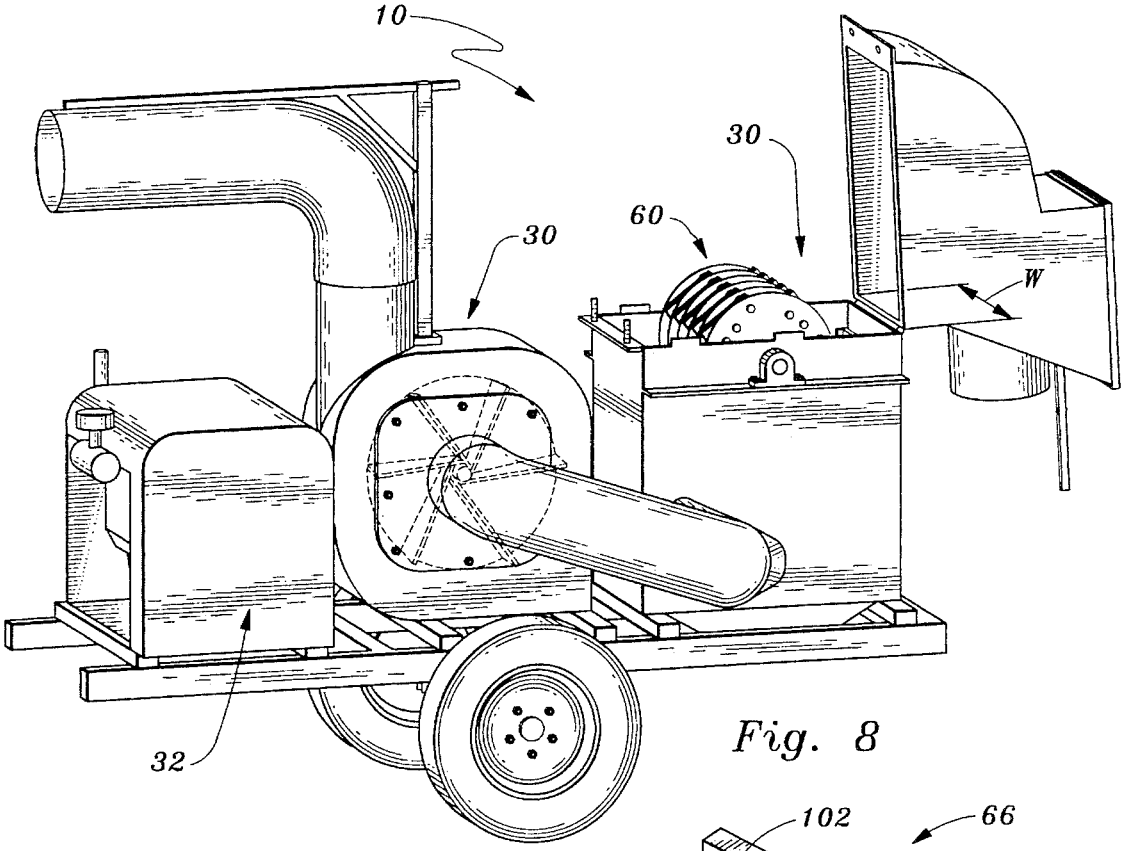
FIG. 8 is a reverse view of the comminuting and air vacuum chambers and engine of FIG. 7 in which a door of the comminuting chamber is shown in an open position to reveal an interior shredding assembly and in which the fan blades of the air flow assembly is shown in phantom line.
Figure 10:
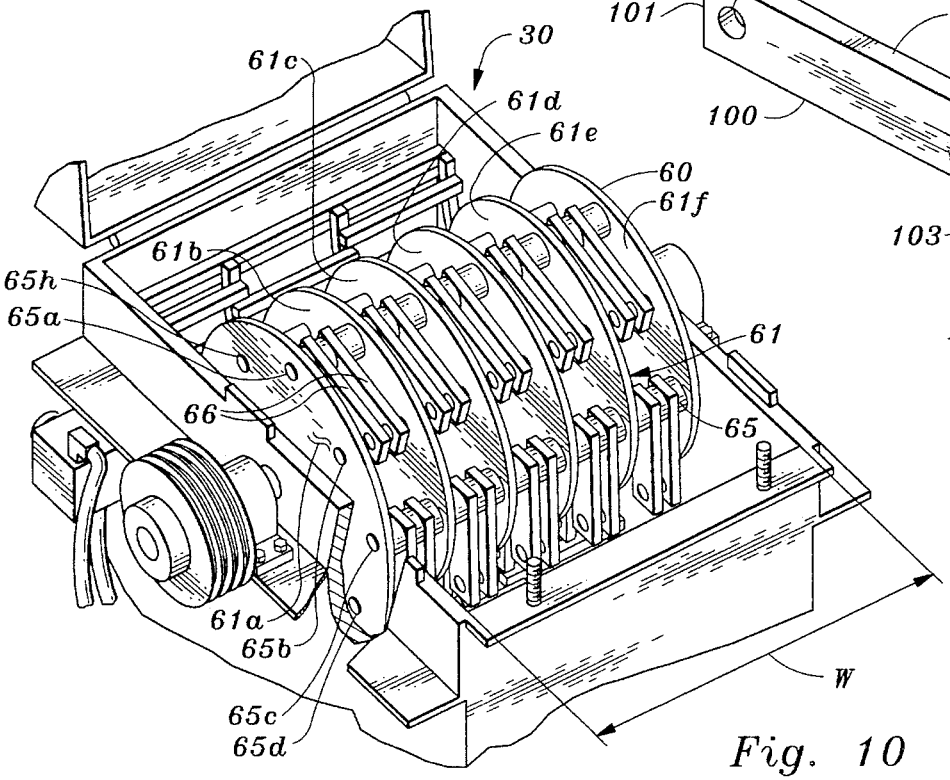
FIG. 10 is a detail perspective view of the shredding assembly of FIG. 8.
Figure 11:
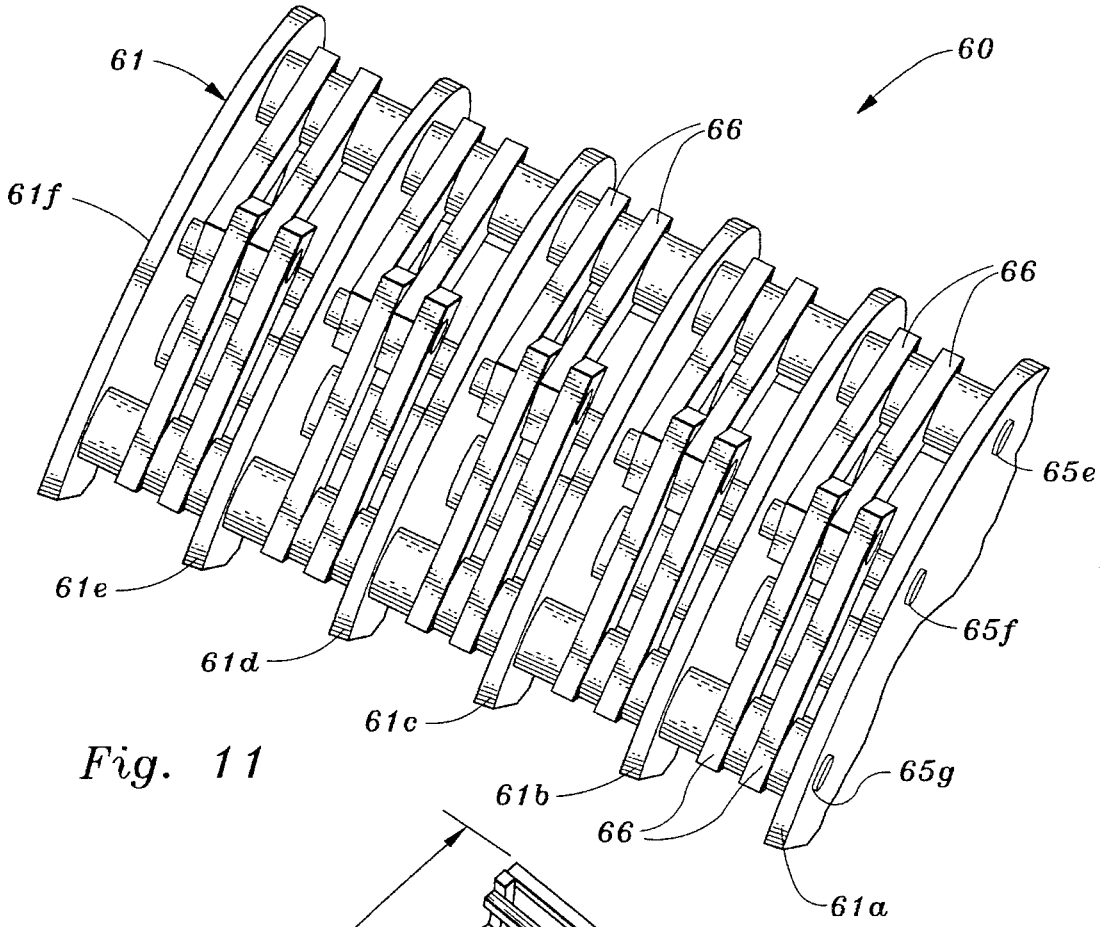
FIG. 11 is a detail perspective view of the hammer subassembly of FIG. 10.

As shown in FIG. 8, the shredding assembly 60 within the comminuting chamber 30 extends across the full width W of the chamber 30. That is, as shown in FIGS. 10 and 11, the series of horizontally stacked discs generally indicated at 61 is spaced across the entire width W starting with end discs 61*a*, 61*f* with stabilizing discs 61*b*, 61*c*, 61*d*, 61*e* located therebetween. In FIGS. 10 and 11, there are thus multiple sets of working hammers 66 at each station defined by support rods 65*a*, 65*c*, 65*e*, 65*g*, i.e., there are ten working hammers 66 per each support rod for a total of forty working hammers 66 comprising the shredding assembly 60. As shown in FIGS. 10 and 11, a series of stabilizing rods 65*b*, 65*d*, 65*f* and 65*h* are positioned in parallel with the support rods 65*a*, 65*c*, 65*e*, 65*f*.

Figure 9:
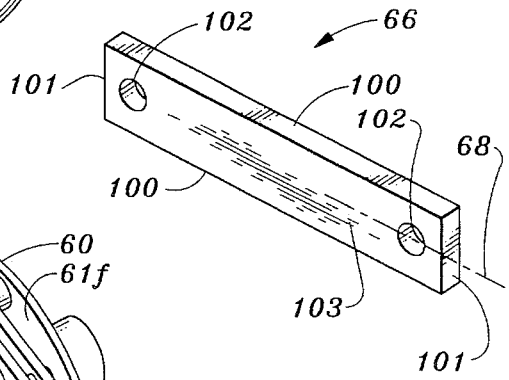
FIG. 9 is a detail perspective view of a hammer of the shredding assembly.

FIG. 9 shows the working hammer 66 in detail.

As shown, each working hammer 66 is of rectangular cross section defining an axis of symmetry 68, side surfaces 100, end surfaces 101 and a pair of openings 102 at each end. The side and end surfaces 100, 101 initially have sharp edges at their intersection with broad surfaces 103 but as operations continue flatten out due to the hammer head action of each hammer 66. Hence, the debris is shredded via pulverizing rather than cutting action. Note that only one of the pair of openings 102 is attached to the support rods 65*a*, 65*c*, 65*e*, 65*g* (see FIGS. 10, 11). However, the design of the hammers 66 allows for more efficient and long-lasting operations, in that each hammer 66 can be reversed in orientation using the other of the pair of openings 102 of FIG. 9 to bring new surfaces into operation.

Figure 12:
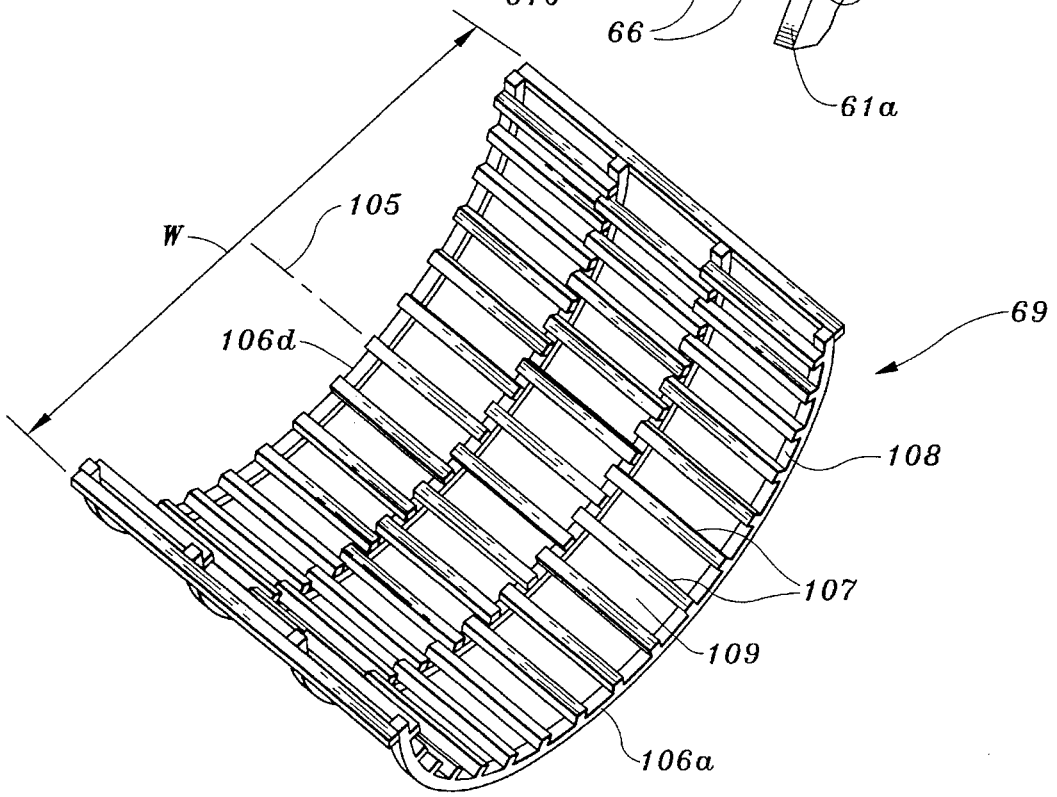
FIG. 12 is a detail perspective view of the grate of the shredding assembly of FIG. 10.

FIG. 12 shows grate 69 in more detail.

As shown, the grate 69 is arcuately shaped and defines a width W matched to that of the comminuting chamber 30 of FIG. 10 wherein its axis of formation 105 is centered at the drive shaft 63, see FIG. 7. The grate 69 has a series of curved rails 106*a*–106*d* also defined by center of formation 105. In addition, a series of support rails 107 extend across and are in attaching contact with broad surfaces 108 of the curved rails 106*a*–106*d*.

Note that openings 109 defined between neighboring support rails 107 are designed to only permit pulverized rocks to pass therethrough. That is, the width of the openings 109 are about 1 inch. Hence, rocks of greater dimensions are pulverized as are rocks of less dimensions due to the addition of garden debris which tends to keep such rocks in the cutting zone a significant period of time to insure their break-up.

METHOD ASPECTS

While the system 10 of FIG. 1 is most conveniently operated in association with the vacuum hose 35 of FIG. 2, there are other forms of inputting debris into the system 10.

Figure 13:
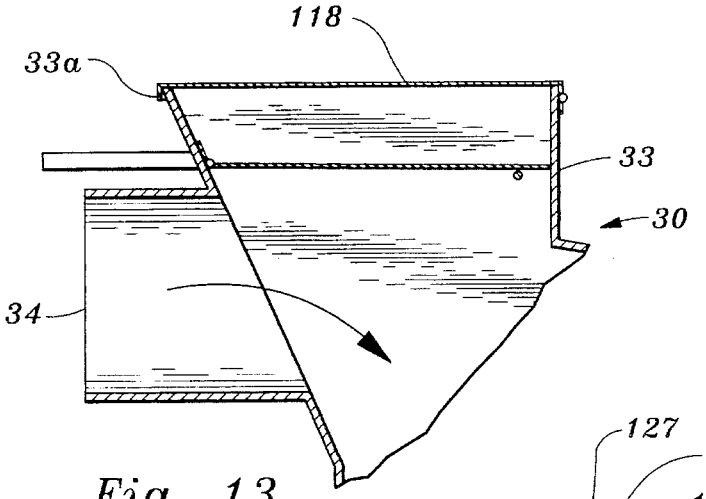
FIG. 13 is a detail side view of the upper input section of the comminuting chamber showing a circular input port to be connected to the vacuum hose of FIG. 2.

As shown in FIG. 3, a conveyor 110 can be used to load debris into the comminuting chamber 30. Such conveyor 110 includes a slanted frame 111 having near end 112*a* and a far end 112*b* provided with a hanger strut 113 for attachment to a new and different input port for comminuting chamber 30, say to a rectangular input port 114 positioned at the upper tier of the chamber 30. The near end 112*a* of the conveyor 110 is provided with a series of upright walls 116 to provide a loading zone 117 for the conveyor 110. Note that the rectangular input port 114 is formed by releasing door 118 from attachment to the ends of the side walls 33 of the comminuting chamber 30, and rotating same about shaft 119 whereby debris is carried from loading zone 117 into the comminuting chamber 30. In such operation, the circular port 34 is provided with a cap 120. However, as shown in FIG. 13 when the former is in use, the door 118 is fitted across ends 33*a* of the side walls 33 of the comminuting chamber 30.

Figure 14:
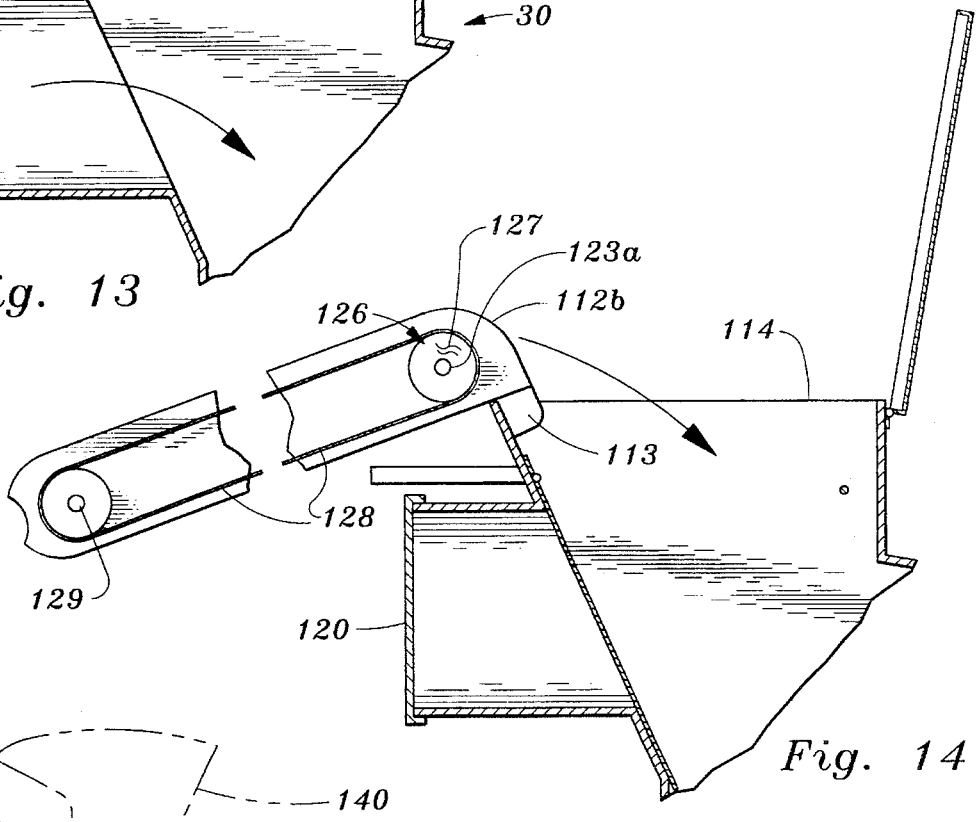
FIG. 14 is another detail side view of the upper input section of comminuting chamber showing a rectangular input port to accept debris from the conveyor of FIG. 3.

Returning to FIG. 3, to operate conveyor 110, a hydraulic motor 123 is operative connected via hoses 124 that pass back to the engine 32 of FIGS. 1 and 7 via a connector assembly 125 and thence to the hydraulic pump 59 of engine 32, see FIG. 9 as previously mentioned. The shaft 123*a* of the hydraulic motor 123 is directly connected to drum-belt assembly 126, see FIG. 14, which includes a drive drum 127, an endless belt 128 and a driven drum 129. To wet the debris in the manner of FIG. 3, a water-carrying conduit 130 is attached to the conveyor 110 and includes a sprayer wand 131 positioned above the loading zone 117 of the conveyor. At its opposite end (not shown), the conduit 130 is attached to the water pump 56 of the water tank 55 of FIGS. 1 and 7 through a quick release coupler 132 and operates in the manner previously described. An ON-OFF valve 133 is attached to said conduit 130 adjacent to the position of the sprayer wand 131 to control the wetting of the un-shredded debris prior to its entry into the comminuting chamber 30 sufficient to reduce generation of air-born dust and associated debris.

Figure 15:
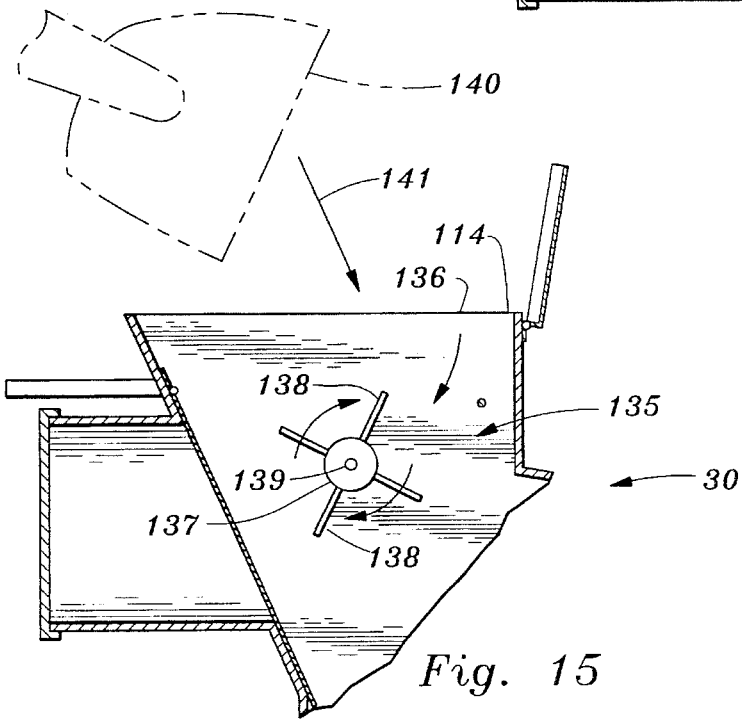
FIG. 15 is yet another detail side view of the upper input section of comminuting chamber showing a rotatable baffle assembly adjacent to the rectangular input port of FIG. 14.

Although the invention has been illustrated and described with respect to exemplary embodiments thereof, it should be understood by those skilled in the art that various changes, omissions, modifications and additions may be made without departing from the spirit of the invention. For example, as shown in FIG. 15, upper tier 135 of the comminuting chamber 30 (associated with rectangular input port 114), can also include a baffle assembly 136 comprising a central hub 137 and spokes 138. In operation the central hub 137 and spokes 138 are rotatable about central shaft 139, as shown, to limit the egress of debris therebelow, where such debris enters into the upper tier 135 in the direction of arrow 141 from a user's shovel 140.

We claim:

1. A balanced comminuting, vacuuming and dust-free loading system for debris containing small rocks up to 3 inches in diameter, lawn clippings, leaves, outcropping of trees, plants and pine needles, a rubber wheeled, self propelled vehicle having a bed for receiving debris after comminution has occurred, said bed including upright walls and a cover releasably attached to said upright walls and including a broad surface provided with an input opening and an output opening, and a filter of filter area A disconnectably connected across said output opening, a frame trailerably attached to an end of said self propelled vehicle adjacent to said bed thereof and including ground engaging wheels defining a datum line, a comminuting chamber attached to said frame at one end thereof having a plurality of said walls upwardly depending from said frame, an input opening a distance D above said datum line, for inputting debris interiorly of said reducing chamber and an output opening through said walls for outputting comminuted debris at distance D1 above said datum line, disc means located within said side walls of said comminuting chamber, including a shaft extending horizontally across said chamber and a driven pulley attached at one end thereof, a series of hammers attached to said disc means and movable therewith, and a grate at the periphery of the disc means through which said debris is comminuted, an air vacuum chamber attached to said frame at a midregion thereof, having an input opening attached to said output opening of said comminuting chamber to provide air flow communication therebetween and an output opening horizontally positioned at a position a distance D2 above said datum line, a flywheel having a shaft and first and second pulleys attached at one end, an endless driven belt attached between said first pulley and said driven pulley of said comminuting chamber, and a series of blades attached to said flywheel and movable therewith, an engine mounted to said frame at another end opposite to said comminuting chamber having a drive shaft selectively rotatable in a range of 1800 to 2200 rpm including a drive pulley and an endless drive belt, said drive belt being attached to said second pulley of said vacuum chamber and providing rotation of said shafts of said comminuting and air pumping chambers in unison and of sufficient speed to drive debris at a flow rate Q through said comminuting chamber, said output opening of said air vacuum chamber thence into said bed of said self propelled vehicle at a high rate without harmful discharge exterior of said bed wherein said filter of filter area A is sufficiently large to accommodate said flow rate Q.

2. The system of claim 1 with the addition of a water carrying conduit having an end opening positioned to wet said debris prior to entry into said comminuting chamber, a reservoir of water carried on said frame connected to said conduit, and an ON-OFF valve attached to said conduit for wetting said debris prior to entry into said comminuting chamber sufficiently to reduce generation of air-born dust and associated debris.

3. The system of claim 2 in which flow rate Q of said debris is in a range of 14,000 to 18,000 cfm.

4. The system of claim 3 in which filter area A is about 66 square feet.

5. The system of claim 2 in which D2>D.

6. The system of claim 2 in which D>D1 whereby gravity aids in flowing said debris through said comminuting chamber.

7. The system of claim 2 with the addition of a vacuum hose having a side wall defining an entrance and an exit connected to said input opening of said comminuting chamber, said side wall having an exterior surface attached to said water-carrying conduit.

8. The system of claim 2 with the addition of a conveyor having a drive drum, a driven drum and an endless belt connected between said drive and driven drums for conveying said debris to said input opening of said comminuting chamber, said conveyor having an exterior surface to which said water-carrying conduit is attached.

9. The system of claim 2 in which said comminuting chamber is provided with a door adjacent to said output opening for permitting unclogging of said grate.

10. The system of claim 1 in which D is 5 feet, D1 is 4 feet and D2 is 7 feet.

11. A balanced comminuting, vacuuming and dust-free loading system for debris containing small rocks up to 3 inches in diameter, lawn clippings, leaves, outcropping of trees, plants and pine needles, a frame including ground engaging wheels defining a datum line, a comminuting chamber attached to said frame having a plurality of side walls upwardly depending from said frame, an input opening a distance D above said datum line, for inputting debris interiorly of said comminuting chamber and an output opening through said side walls for outputting comminuted debris at distance D1 above said datum line, disc means located within said side walls of said comminuting chamber across the entire width of said comminuting chamber, including a shaft extending horizontally across said chamber, a first driven pulley attached at one end of said shaft and a endless belt attached to said pulley, a series of hammers attached to said disc means and movable therewith, and a grate at the periphery of the disc means through which said comminuted debris egresses from said comminuting chamber, an air vacuum chamber attached to said frame having an input opening attached to said output opening of said comminuting chamber to provide air flow communication therebetween and an output opening horizontally positioned at a position a distance D2 above said datum line, a flywheel having a shaft and a second pulley attached at one end to said endless driven belt of said first driven pulley of said comminuting chamber, said shaft also having a far region extending horizontally across said air vacuum chamber, and a series of blades attached to said flywheel and movable therewith, an engine mounted to said frame having a drive shaft selectively rotatable in a range of 1800 to 2200 rpm including a drive pulley and an endless drive belt, said drive belt being attached to said first and second pulleys of said shafts of said comminuting and air pumping chambers for providing rotation in unison of sufficient speed to drive debris at a flow rate Q through said comminuting and air vacuum chambers and exterior thereof at said flow rate Q.

12. The system of claim 11 with the addition of a water carrying conduit having an end opening positioned to wet said debris prior to entry into said comminuting chamber, a reservoir of water carried on said frame connected to said conduit, and an ON-OFF valve attached to said conduit for intermediate wetting said debris prior to entry into said comminuting chamber sufficiently to reduce generation of air-born dust and associated debris.

13. The system of claim 12 in which flow rate Q of said debris is in a range of 14,000 to 18,000 cfm.

14. The system of claim 13 with the addition of a rubber wheeled, self propelled vehicle trailerably attached to said frame, said vehicle having a bed for receiving debris after comminuting has occurred, said bed including a removable cover comprising an input opening and an output opening, and a filter of filter area A disconnectably connected across said output opening, said filter area A being about 66 square feet.

15. The system of claim 12 in which D2>D.

16. The system of claim 12 in which D>D1 whereby gravity aids in flowing said debris through said comminuting chamber.

17. The system of claim 12 with the addition of a vacuum hose having a side wall defining an entrance and an exit connected to said input opening of said comminuting chamber, said side wall having an exterior surface attached to said water-carrying conduit.

18. The system of claim 12 with the addition of a conveyor having a drive drum, a driven drum and an endless belt connected between said drive and driven drums for conveying said debris to said input opening of said comminuting chamber, said conveyor having an exterior surface to which said water-carrying conduit is attached.

19. The system of claim 12 in which said comminuting chamber is provided with a door adjacent to said output opening for permitting unclogging of said grate.

20. The system of claim 11 in which D is 5 feet, D1 is 4 feet and D2 is 7 feet.

* * * * *